US005400812A

United States Patent [19]

MacFarlane

[11] Patent Number: 5,400,812

[45] Date of Patent: Mar. 28, 1995

[54] CLEANING APPARATUS FOR PRINTING SCREEN

[75] Inventor: David W. MacFarlane, Carnforth, England

[73] Assignee: Technijet Limited, Lancashire, England

[21] Appl. No.: 87,696

[22] PCT Filed: Jan. 8, 1992

[86] PCT No.: PCT/GB92/00041

§ 371 Date: Jul. 9, 1993

§ 102(e) Date: Jul. 9, 1993

[87] PCT Pub. No.: WO92/12013

PCT Pub. Date: Jul. 23, 1992

[30] Foreign Application Priority Data

Jan. 12, 1991 [GB] United Kingdom ..... 9100697

[51] Int. Cl.[6] ..... B08B 3/02

[52] U.S. Cl. ..... 134/152; 134/169 R; 134/170

[58] Field of Search ..... 134/36, 34, 35, 42, 134/54, 64 R, 122 R, 152, 169 R, 170

[56] References Cited

U.S. PATENT DOCUMENTS 3,679,483 7/1972 Zweig ..... 134/46
4,808,237 2/1989 McCormick et al. ..... 134/26

FOREIGN PATENT DOCUMENTS 2136556 12/1972 France .
527059 8/1972 Germany .
8702417 5/1989 Netherlands .
1370568 4/1972 United Kingdom .

*Primary Examiner*—Paul Lieberman
*Assistant Examiner*—Lorna M. Douyon
*Attorney, Agent, or Firm*—Richard E. Jenkins

[57] ABSTRACT

Cleaning apparatus 10 comprises an enclosed washtank 12 and a screen loading unit 13. A pump is arranged to deliver high pressure heated water to an internal screen cleaning nozzle arrangement 14 and a ring-shaped external screen cleaning nozzle arrangement 15 which nozzle arrangements 14, 15 are arranged in a gap 19 between a screen support skid 16 and an entry screen support skid 17. The nozzle arrangement 14 is arranged to direct a spray of water outwardly; the nozzle arrangement 15 is arranged to direct a spray of water inwardly. In use, a cylindrical printing screen to be cleaned is pushed into the apparatus whilst high pressure heated water is being delivered by the internal and external nozzle arrangements 14, 15. As each portion of the screen is disposed opposite the gap 19, between support skids 16 and 17, that portion of the screen is washed on its inside and outside by water directed from the nozzle arrangements 14 and 15 respectively. The screen is pushed into the washtank 12 until the whole length of the screen has passed opposite the gap 19. The cleaned screen is then removed. Water directed from the nozzle arrangements 14, 15 is arranged to contact opposite sides of the screen at superimposed positions so that substantially no resultant force is incident on the screen during cleaning. The use of high pressure, heated water may result in the cleaning of screens at relatively low flow rates of water.

18 Claims, 7 Drawing Sheets

CLEANING APPARATUS FOR PRINTING SCREEN

This invention relates to cleaning apparatus and cleaning methods and particularly, although not exclusively, to apparatus for and methods of cleaning printing screens, for example, cylindrical nickel printing screens.

In textile printing, paper-thin cylindrical nickel printing screens, for example, having a length of 3.5 m and a diameter of 202 mm, may be utilized. Such screens are very fragile and are easily damaged.

After printing, a printing screen needs washing to remove residual ink and fabric, transferred from the textile being printed upon, which has built up on the screen.

A number of means have been used to clean printing screens. For example, a screen to be washed may be sprayed with water from a hose pipe. However, such random spraying may cause unequal, random forces on the fragile screen and may cause total collapse of the screen where the spray impinges. An alternative known cleaning apparatus, shown in end elevation in FIG. 1, comprises two contrarotating abrasive brushes 1 which are arranged to dislodge fabric from the screen 2 by abrasion. The brushes, however, have limited effect in the cleaning of the paper-thin screen. Removal of fabric from screens has also been accomplished by chemical means. For example, a strong chemical may be applied to a screen to degrade fabric attached thereto. However, the use of chemical means is potentially hazardous to personnel applying the chemical and, furthermore, the cost of chemicals is not insignificant.

In general terms, it is also noted that the aforementioned means of cleaning screens tends to result in a screen being handled manually to a relatively large degree. Since the screen is of relatively large length and is made of paper-thin nickel, such handling results in damage to the screen. For example, the screen may fairly readily fold or become dented.

It is an object of the invention to improve upon the aforementioned problems.

According to a first aspect of the present invention, there is provided apparatus for cleaning a screen, the apparatus comprising first fluid directing means arranged to direct a cleaning fluid towards a first position on a first side of a screen and second fluid directing means arranged to direct a cleaning fluid towards a second position on a second side of the screen, wherein said first and second positions are substantially superimposed.

Said first position may comprise a first area and said second position may comprise a second area. Said first and second areas are preferably substantially equal. Said first and second areas may suitably not be directly superimposed but overlap each other to some extent. This may be important when a perforated screen is being cleaned, since if the areas are directly superimposed, the fluid directing means may cancel each other out.

Preferably, said first and second fluid directing means are arranged such that the force of fluid impinging the screen at said first position due to said first fluid directing means is substantially balanced by the force of fluid impinging the screen at said second position due to said second fluid directing means. To achieve this, said first and said second fluid directing means are suitably fed with fluid from the same fluid source.

Suitably, said first and/or said second fluid directing means are arranged to receive and direct a fluid having a pressure of up to 1500 psi ($1\times10^7$ N/m$^2$).

Said first fluid directing means and/or said second fluid directing means may be arranged to direct fluid towards a plurality of positions on first and second sides of the screen respectively. Fluid directed to each of said plurality of positions on the first side is preferably superimposed by fluid directed to said plurality of positions on the second side.

Preferably, the first fluid directing means is arranged to direct a substantially endless band of cleaning fluid at a screen to be cleaned. Preferably the second fluid directing means is arranged to direct a substantially endless band of cleaning fluid at a screen to be cleaned. Preferably, said endless bands of fluid are superimposed, in use.

Preferably, one, more preferably, both of said bands is substantially annular. Suitably, the screen to be cleaned is substantially circularly cylindrical and is preferably a printing screen. The screen may be perforate. Said first fluid directing means may be arranged to direct a band of fluid around an outside surface of a screen to be cleaned. Said second fluid directing means may be arranged to direct a band of fluid around an inside surface of a screen to be cleaned. Thus, in a preferred embodiment, said first and said second fluid directing means are arranged to direct fluid at substantially superimposed positions on the respective outside and inside surfaces of a screen.

The apparatus may further comprise pump means for supplying a pressure fluid to said fluid directing means. Suitably, said pump means is arranged to supply a fluid at a pressure of greater than 750 psi ($5\times10^6$ N/m$^2$), suitably greater than 1000 psi ($6.7\times10^6$ N/m$^2$), preferably greater than 1100 psi ($7.33\times10^6$ N/m$^2$). Said pump means may be arranged to deliver more than 25 liters/minute of fluid to said fluid directing means, preferably more than 40 liters/minute. The pump means is preferably arranged to deliver about 40 to 60 liters/minute. Thus, approximately 40 to 60 liters/minute in total of fluid may, in use, impinge upon the first and second sides of the screen to be cleaned—that is 20–30 liters/minute on each side.

The pressure fluid is preferably a liquid, for example, water. It may, however, be a gas.

It should be noted that the use of a fluid at the pressure described herein may allow a relatively low fluid flow rate to be used for cleaning in comparison to prior art apparatus. For example, one known prior art apparatus uses over 450 liters/minute of fluid. Thus, the apparatus may allow significant savings in effluent discharge costs.

Said first fluid directing means and/or said second fluid directing means are preferably provided at fixed locations of the apparatus.

Said first and/or said second fluid directing means preferably comprise a plurality of nozzle means communicating with a fluid supply, the nozzle means being circumferentially spaced, preferably at regular intervals. Suitably, eight circumferentially spaced nozzle means are provided at 45° intervals. The nozzle means are suitably about 65° nozzles. That is, they produce a substantially 65° segment of fluid. In the case of said first fluid directing means, the nozzle means may be supported on a structure of regular cross-section, for example, on an octagonal or circular ring-shaped structure. In the case of the second fluid directing means nozzles may be supported on a fluid supply pipe. The nozzles of the first and/or second fluid directing means may, in addition to being circumferentially spaced, be axially spaced. For example two axially spaced rows of nozzle means may be provided, each row comprising, for example, four circumferentially spaced nozzle means.

The apparatus preferably further comprises guide means for guiding the position of a screen to be cleaned relative to the fluid directing means. Said guide means is suitably of part circular, for example, semi-circular, cross-section. The guide means suitably defines a trough into which a screen of circular cross-section may fit. Suitably, the diameter of cross-section of said guide means and said screen are substantially equal. The guide means is suitably arranged to provide guided sliding movement of the screen. The guide means is preferably in at least two parts with a gap therebetween, into which gap said first and second fluid directing means are arranged generally to direct fluid.

The apparatus is preferably arranged to accommodate a screen having a length in the range about 1 m to 5 m, preferably in the range about 1.5 m to 3.5 m, and having a diameter in the range about 0.1 m to 0.5 m, preferably in the range about 0.15 m to 0.35 m, and having a thickness in the range 0.1 mm to 0.5 mm, more preferably in the range 0.084 mm to 0.40 mm.

The apparatus may further comprise loading means which may comprise a loading guide means arranged to accommodate a screen to be cleaned.

Preferably, said loading guide means and said guide means, when provided, are arranged directly opposite to one another. Said loading guide means may be arranged as mentioned in relation to said guide means. Alternatively or additionally, said loading guide means may include two or more transversely spaced apart troughs supported on a support member and moveable relative thereto. Selector means may then be provided for selecting which trough is disposed opposite to said guide means.

The apparatus may include heating means for heating cleaning fluid. The use of heated cleaning fluid may allow a reduced flow rate to be used in comparison to a case wherein cleaning fluid is not heated. This may allow significant savings in effluent discharge costs. Preferably, the cleaning fluid used consists exclusively of or is predominantly water. The apparatus may be made wholly or in part of stainless steel.

According to a second aspect of the invention, there is provided a method of cleaning a screen, the method comprising directing a cleaning fluid towards a first position on a first side of the screen and directing a cleaning fluid towards a second position on a second side of the screen, wherein said first and said second positions are substantially superimposed.

Suitably, a force due to said cleaning fluid impinging said screen at said first position is substantially balanced by a force due to said cleaning fluid impinging said screen at said second position so that there is substantially no resultant force on said screen at said first and second superimposed positions. Cleaning fluid is suitably directed in a first direction towards said first side of said screen and cleaning fluid is suitably directed in a second direction towards said second side of said screen, said first and second directions being substantially opposite. Suitably, the screen is a printing screen as described herein.

Said screen may be as described in any statement herein. It is preferably a cylindrical screen which more preferably is circularly cylindrical.

Preferably, in the method, the fluid is directed at the screen so as to impinge upon a circumferential band of the screen. Fluid is suitably directed by first fluid directing means towards a first position on an inside surface of the screen and by second fluid directing means towards a second position on an outside surface of the screen. Suitably, a force of fluid on the inside surface of the screen is more or less balanced by an opposing force of fluid on the outside surface of the screen, so that there is substantially no resultant force on the screen due to the impingement of cleaning fluid.

The method may further comprise directing a cleaning fluid, having a temperature greater than ambient temperature, at the screen to be cleaned. In this case, the method may be of utility for the removal of water soluble inks and may be applicable to the removal of pigment colour inks from a printing screen. The method may be applied to the removal of inks which are cured or dried in use by heat, for example, by dry heat.

Instead of causing printing ink to dry more quickly, as expected, the use of cleaning fluid having a temperature as aforementioned, has been found, surprisingly, to result in an increase in efficiency of cleaning.

The temperature of the cleaning fluid may be in the range 30° C. to 90° C. preferably in the range 50° C. to 90° C., more preferably in the range 60° C. to 80° C.

Preferably the method uses apparatus as described in any statement herein.

According to a third aspect, there is provided a method of cleaning a substantially cylindrical screen, the method comprising directing a cleaning fluid at the screen from a plurality of predetermined spaced apart locations.

According to a fourth aspect, there is provided a method of cleaning a printing screen, the method comprising directing a cleaning fluid, having a temperature greater than ambient temperature, at the printing screen.

The invention extends to a method according to the second aspect in combination with a method according to the third aspect and/or with a method according to the fourth aspect. The apparatus as described in any statement herein may be used in the methods according to the second and/or third and/or fourth aspects.

Specific embodiments of the invention will now be described, by way of example, with reference to the accompanying diagrammatic drawings.

Figure 1:
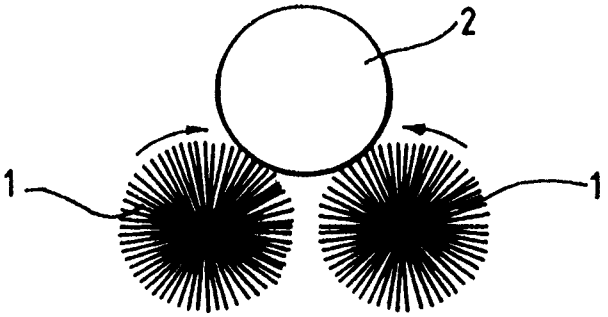
Fig.1. (PRIOR ART)
FIG. 1 is a prior art cleaning apparatus showing two contrarotating abrasive brushes.
Figure 2A:
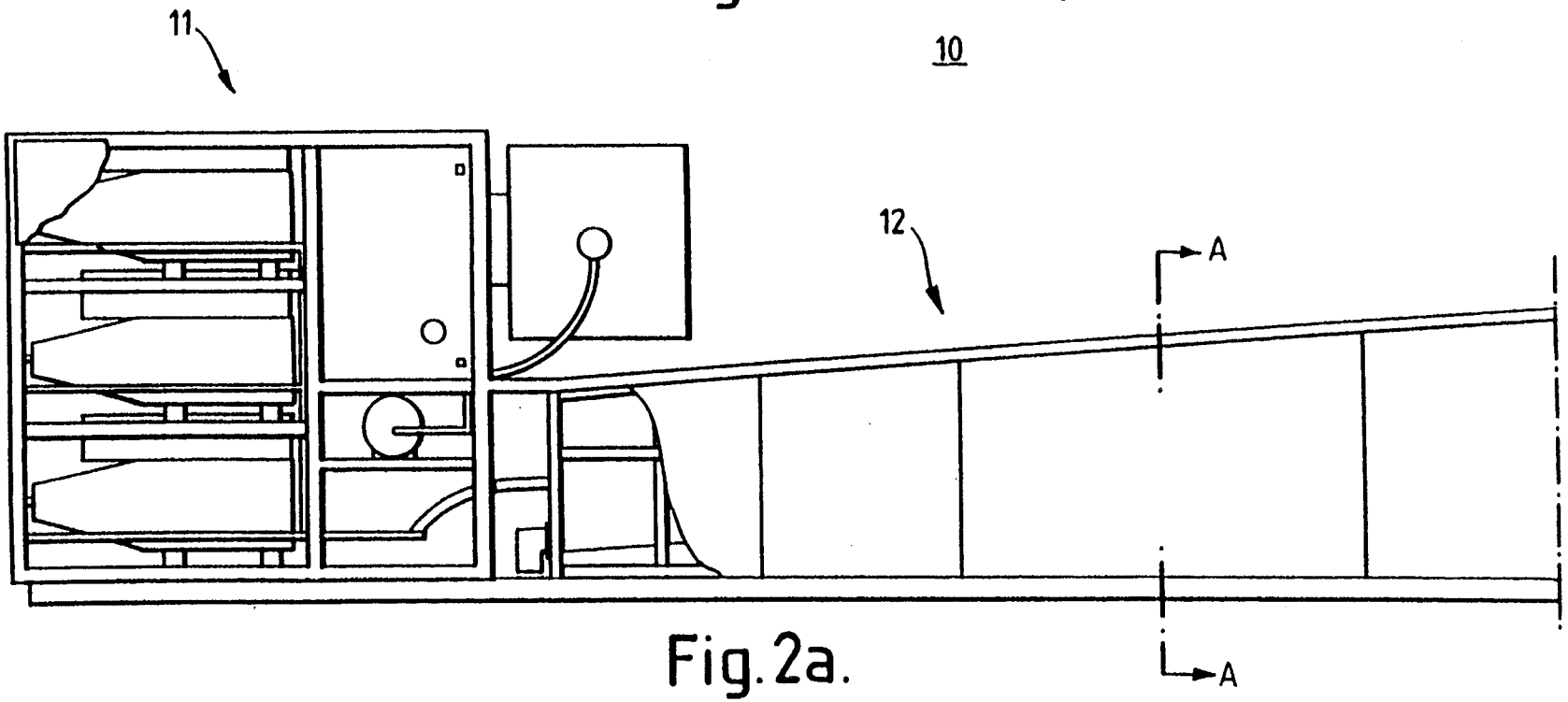
FIG. 2*a* is a side elevation of cleaning apparatus up to a line A—A.
Figure 2B:
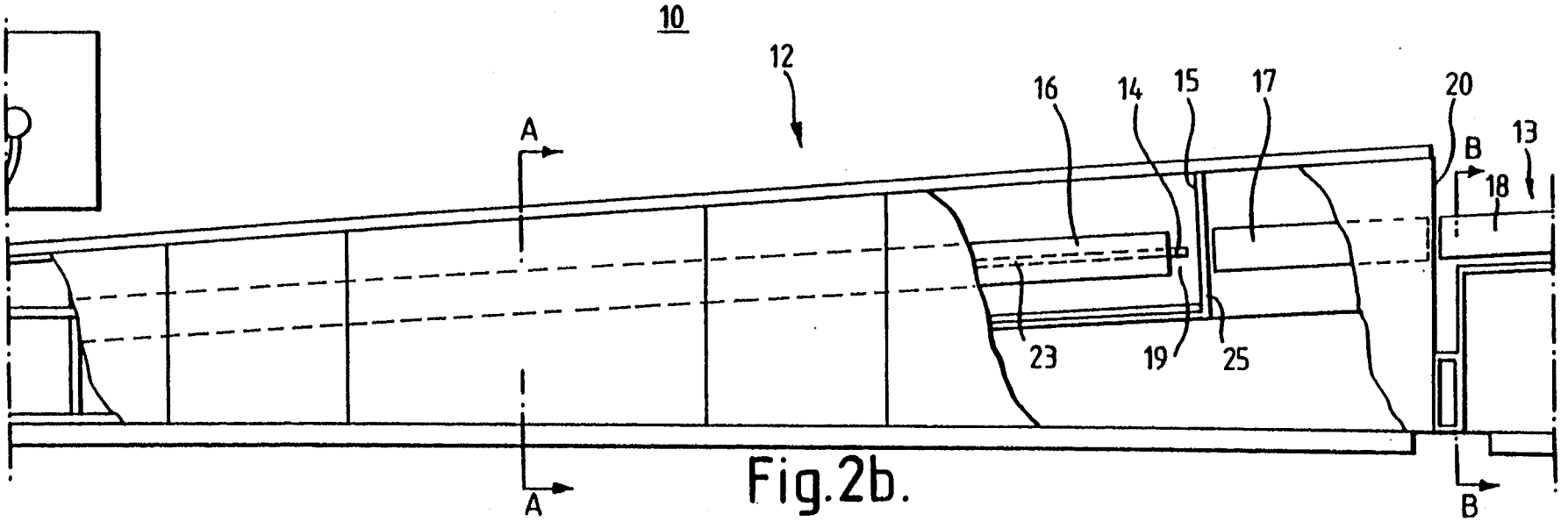
FIG. 2*b* is a continuation of the cleaning apparatus shown in FIG. 2*a* to the right of line A—A.
Figure 2C:
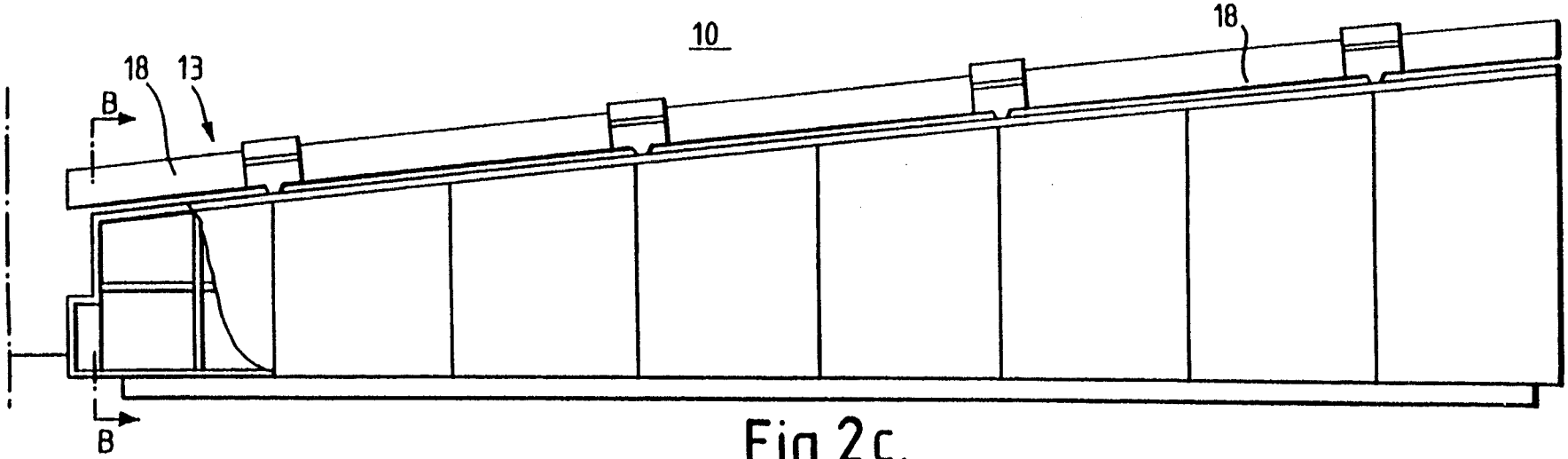
FIG. 2*c* is a continuation of the cleaning apparatus to the right of line B—B as seen in FIG. 2*b;*

Cleaning apparatus 10, shown in FIGS. 2*a*, 2*b* and 2*c*, comprises a pump house 11, an enclosed wash tank 12 and a loading unit 13, supported on a framework. The pump house 11 is arranged to deliver high pressure water to an internal screen cleaning nozzle arrangement 14 and a ring-shaped external screen cleaning nozzle arrangement 15, which nozzle arrangements 14, 15 are arranged in a gap 19 between a screen support skid 16 and an entry screen support skid 17. The nozzle arrangement 14 is arranged to direct a spray of water outwardly; the ring-shaped nozzle arrangement 15 is arranged to direct a spray of water inwardly towards the centre of the ring. The loading unit 13 includes a loading skid 18 which is positioned adjacent to and directly opposite to the entry skid 17. The screen support skid 16, entry screen support skid 17 and loading skid 18 include a semi-circular recess of substantially the same diameter as that of a cylindrical printing screen to be cleaned, the skids 16, 17, 18 thereby being arranged to support the cylindrical printing screen during passage into and from the apparatus 10.

In use, a cylindrical printing screen to be cleaned is placed into the semi-circular recess in the loading skid 18. Then, pumps (not shown) within the pump house 11 are actuated to deliver water under high pressure to the internal and external nozzle arrangements 14, 15. The internal nozzle arrangement 14 directs water outwardly; the external nozzle arrangement 15 directs water inwardly. The printing screen, whilst supported on the loading skid 18, is then pushed manually to slide through a wash tank entry/exit port 20 onto the entry skid 17 in the wash tank 12. From the entry skid 17, the screen is pushed onto the support skid 16. Gradually the whole length of the screen is pushed from the loading skid 18 to the support skid 16 via the entry skid 17, the screen sliding on the skids. As each portion of the screen is disposed opposite the gap 19, between support skid 16 and entry skid 17, that portion of the screen is washed on its inside by means of water directed outwardly from the nozzle arrangement 14 and is washed on the outside by water directed inwardly from the nozzle arrangement 15. The screen is pushed into the wash tank 12 until the whole length of the screen has passed opposite the nozzle arrangements 14, 15 and thereby the whole length of the screen is washed. The screen is then removed from the wash tank 12, via the wash tank entry/exit port 20 and, as the screen passes opposite the nozzle arrangements 14, 15, during removal, the screen is washed a second time. During this second washing any extraneous material removed from the screen is directed, due to the disposition of the nozzle arrangements 14 and/or 15 (see later), away from the entry/exit port 20. The washed screen is removed from the apparatus onto the loading skid 18 of loading unit 13 and from the loading unit 13 for further use in printing, as required.

Features of the cleaning apparatus will now be described in greater detail.

Figure 3A:
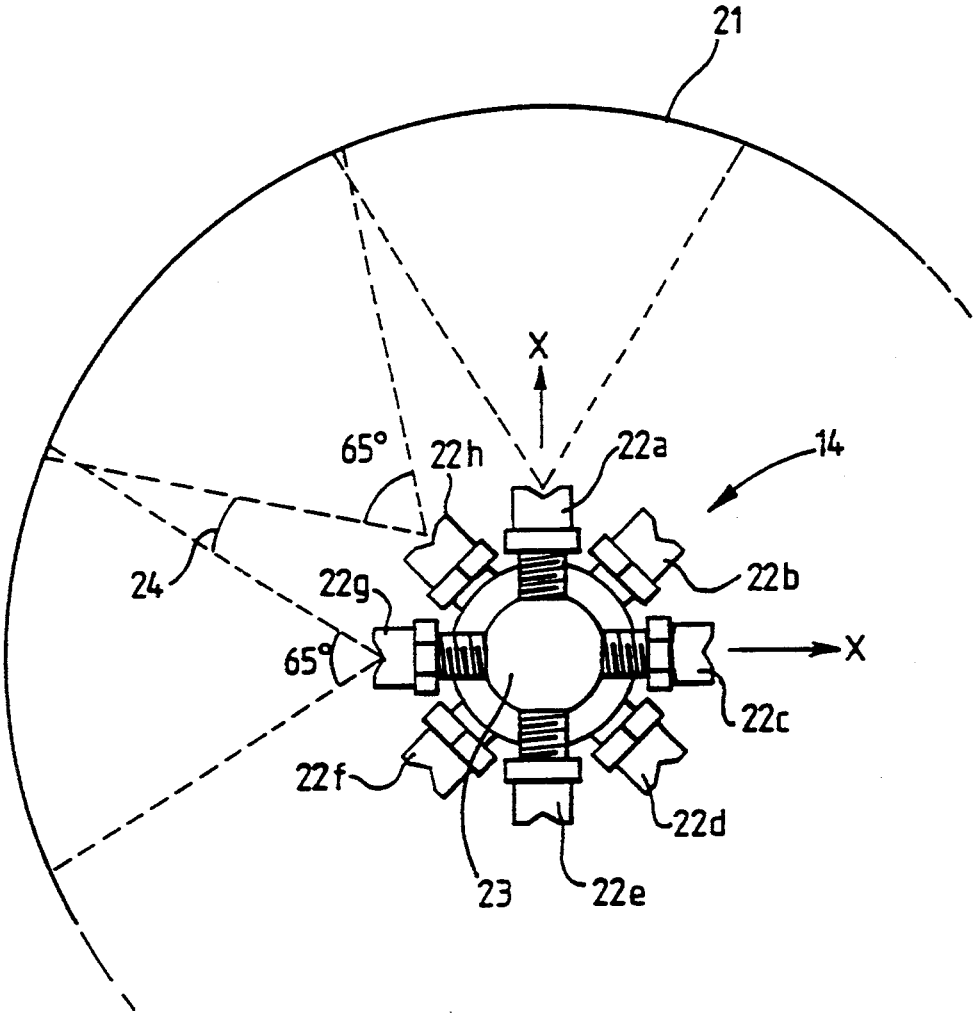
FIG. 3*a* is an enlarged cross-section through an internal screen cleaning nozzle arrangement and showing part of a screen to be washed.
Figure 3B:
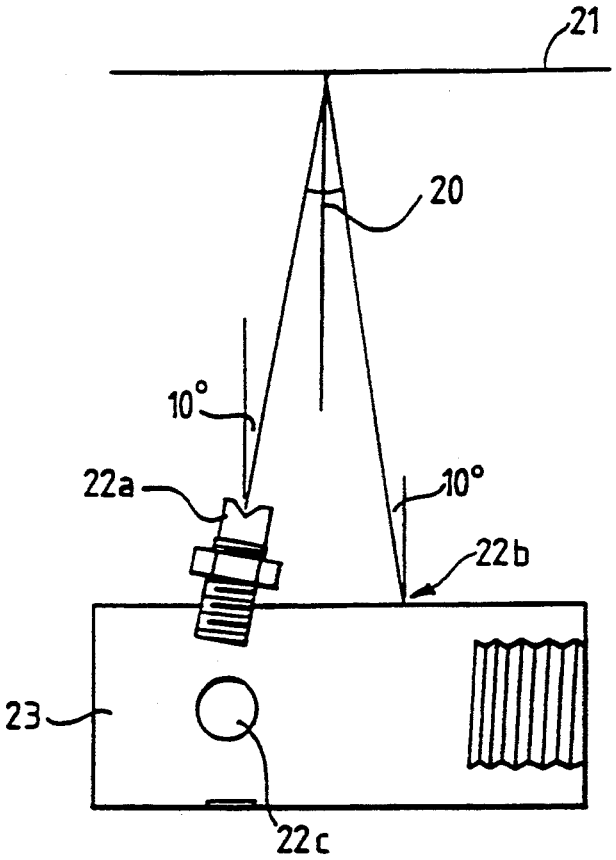
FIG. 3*b* is a schematic cross-sectional view along the line X—X of FIG. 3*a;*

In FIG. 3*a*, the internal screen cleaning nozzle arrangement 14 is shown concentrically disposed within a cylindrical screen 21 to be cleaned. The nozzle arrangement 14 comprises eight circumferentially spaced nozzles 22*a* to 22*f* which are screw-threadedly retained in a delivery pipe 23, which is arranged to deliver water to the nozzles, which nozzles may then direct a spray of water at an inside surface of the screen 21. A first set of nozzles 22*a*, 22*c*, 22*e* and 22*g* are circumferentially spaced at 90° to one another but are not mutually axially spaced. Similarly, a second set of nozzles 22*b* 22*d*, 22*f* and 22*h* are circumferentially spaced at 90° to one another about the pipe 23 but are not mutually axially spaced. The first set of nozzles (i.e. 22*a*, 22*c*, 22*e* , and 22*f*) are axially spaced relative to the second set of nozzles (i.e. 22*b*, 22*d*, 22*f* and 22*h*), as shown schematically in FIG. 3*b*. (N.B. In FIG. 3*b*, nozzle 22*b* is represented as a point source). As apparent from FIG. 3*b*, the first and second sets of nozzles are disposed at an acute angle of 10° to a diametrical plane of the pipe 23 and the first set and second set are angled inwardly towards one another so that the angle between the first set and second set is 20°. Each of the nozzles 22 has a spray angle of 65° and is arranged to produce a thin segmental fluid spray. It will, therefore, be appreciated that the result of eight nozzles each having a spray angle of 65° and disposed as shown in FIG. 3*a* is that a narrow circumferential band of the screen 21 may be sprayed with water at one time.

Thus, in use, as the screen 21 is pushed through the wash tank 12 as described previously, the nozzle arrangement 14 sprays water at, and washes, a narrow circumferential band of the screen which is disposed opposite the spray arrangement 14. As each portion of the screen passes the spray arrangement, that portion is sprayed with water. When the whole length of the screen has passed the spray arrangement the whole length of the screen has been sprayed with water.

It is preferred to arrange the nozzle arrangement 14 such that, in use, a segmental fluid spray from each nozzle intersects a segmental fluid spray from each adjacent nozzle at the position of the cylindrical screen 21, as shown in FIG. 3*a*. If, however, for example, the circumference of the screen is positioned coincident and concentric with an arc 24, it will be noted that nozzles 22*g* and 22*h* will not direct a spray at the position of arc 24. Similarly, if the circumference of the screen is spaced substantially from the point of intersection of fluid from adjacent sprays, the effectiveness of the incident spray on the inside of the screen may be reduced.

Figure 4B:
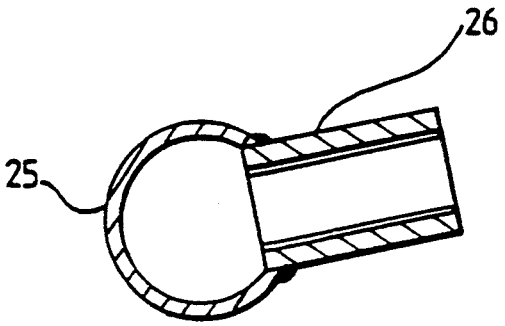
FIG. 4*b* is a cross-section view along line Y—Y of FIG. 4*a;*
Figure 4A:
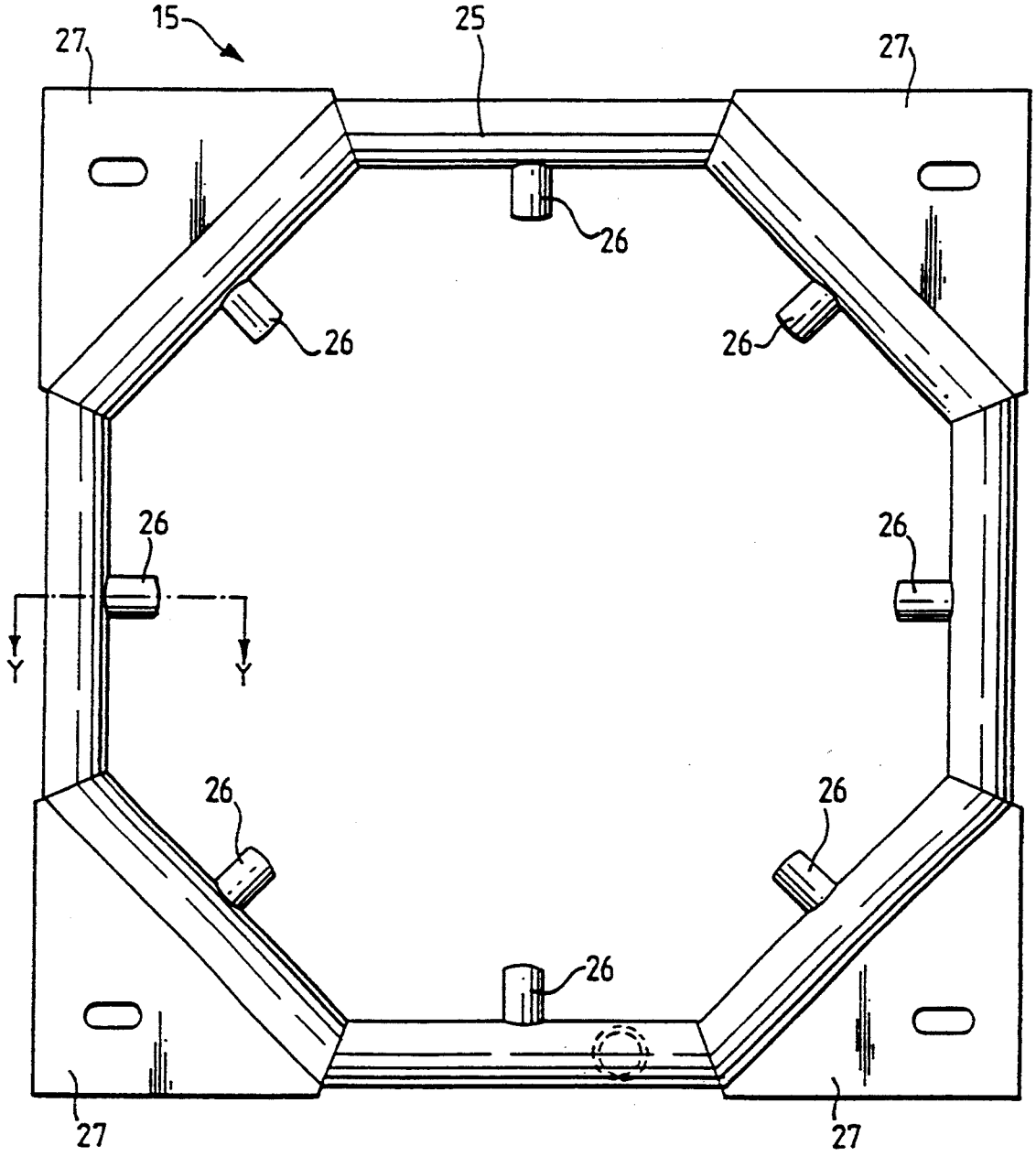
FIG. 4*a* is an enlarged cross-section through an external screen cleaning nozzle arrangement.

The ring-shaped external screen cleaning nozzle arrangement 15, shown in FIGS. 4*a* and 4*b*, comprises an octagonal supply and support tube 25 with a nozzle 26, having an angle of spray of 65°, being provided on each octagonal inner face thereof. Each of the eight nozzles 26 is angled at 10° relative to the main plane of the octagonal tube 25, as shown in FIG. 4*b*. As a consequence of this arrangement, extraneous material removed from the screen during its removal from the wash tank 12 is directed away from the entry/exit port 20 and already cleaned parts of the screen are not recontaminated. The arrangement 15 includes fixing plates 27 for fixing the arrangement in a position concentric with the internal nozzle arrangement 14 and the support skid 16.

In use, as described in relation to the nozzle arrangement 14, the eight nozzles 26 are arranged to spray water at, and thereby wash, a narrow circumferential band of the screen opposite the spray arrangement 15. In this case, since the screen is within the octagonal tube 25, in use, the nozzle arrangement 15 sprays an outside surface of the screen.

Figure 5:
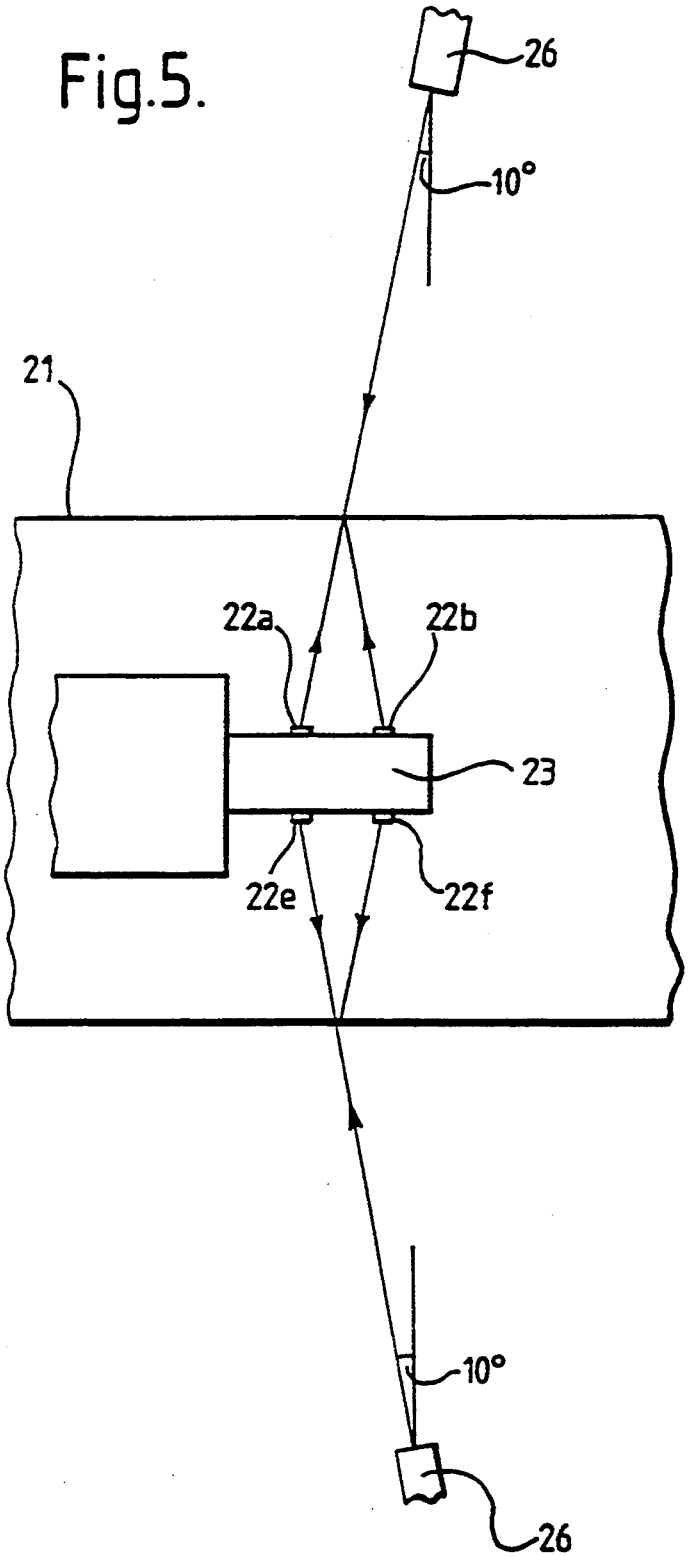
FIG. 5 is an enlarged schematic side elevation showing internal and external screen cleaning nozzle arrangements in use in the cleaning of a screen.

The internal and external screen cleaning nozzle arrangements 14, 15 respectively are arranged to direct water at effectively superimposed positions on the circumference of the screen 21, albeit the internal nozzle arrangement 14 directs water at an inside circumferential surface of the screen and the external nozzle arrangement directs water at an outside circumferential surface of the screen. For example, as shown in FIG. 5, water directed from nozzles 26 impinges upon the outside of screen 21 at substantially the same circumferential positions as water directed from nozzles 22 impinges the inside of screen 21. As described below, the pressure of water from nozzle arrangements 14 and 15 are substantially equal. Thus, the force on an inside circumferential band of the screen due to water from the internal nozzle arrangement 14 is substantially balanced by the force on an outside circumferential band of the screen due to water from the external nozzle arrangement 15, since each nozzle arrangement 14, 15 sprays superimposed circumferential bands having substantially the same area. Thus, there is substantially no resultant force of water on the screen 21 due and, accordingly, damage of the screen 21 to inequality of forces thereon may be reduced.

The pump house 11 houses three pumps capable of delivering a combined pressure of about 1500 psi ($1.6\times10^7$ N/m$^2$). The three pumps are arranged to pump water through a single transfer pipe which splits off so as to feed both the internal and external nozzle arrangements 14, 15. Thus, the force on the screen due to the internal and external nozzle arrangements is substantially the same since the source of water pressure in each case emanates from the same origin—i.e. the single transfer pipe. Suitably the pressure on the screen due to each respective arrangement is no greater than 1500 psi ($1\times10^7$ N/m$^2$) and is no less than 1000 psi ($0.7\times10^7$ N/m$^2$). Preferably, the pressure is about 1200 psi ($0.8\times10^7$ N/m$^2$). The pumps suitably are able to deliver up to 20–30 liters/minute of fluid to each of the nozzle arrangements.

Figure 6:
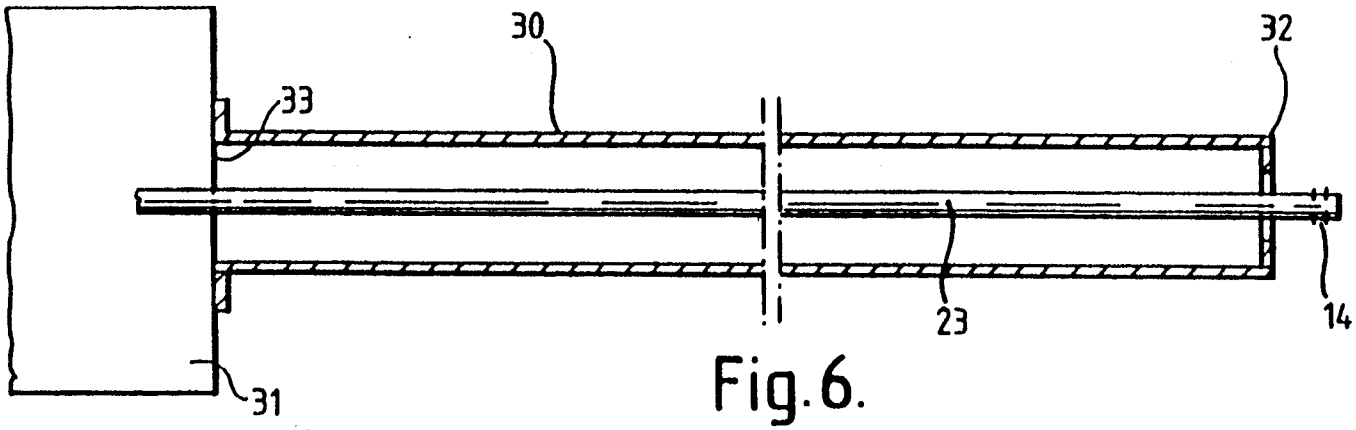
FIG. 6 is a diagrammatic side elevation showing how the internal screen cleaning nozzle arrangement is supported.

The delivery pipe 23 for the internal nozzle arrangement may be supported as shown in FIG. 6. (N.B. for purposes of clarity this Figure is the only Figure which shows this feature). In FIG. 6, an external pipe 30 is rigidly fixed, as its sole means of support, to a support member 31 which is positioned at or adjacent the pump house 11. The rigid delivery pipe 23 which carries high pressure water in use, fits within the pipe 30 and is supported at spaced apart positions thereby. The pipe 23 is fixed at or adjacent position 32, at least, and is arranged so that any expansion of the pipe 23 relative to the pipe 30 (for example, when hot water is passed through the pipe 23) does not result in substantially any movement in the position of the nozzle arrangements 14. The pipe 23 is suitably allowed to expand at or adjacent end 33 thereof. The provision of this "pipe within a pipe" arrangement provides a means whereby the nozzle arrangement 14 can be held in a fixed position, even when the high pressure, hot water is being discharged therefrom.

The pump house 11 may suitably further comprise heating means for heating water supplied to the nozzle arrangements 14, 15. It has been found, surprisingly, that hot water may be used to wash nickel printing screens contaminated with ink and/or fabric. Hitherto, it was believed that, since the ink used in screen printing is cured or dried by means of heat, the use of hot water in cleaning would serve simply to cure or dry the ink and thereby make it more difficult to clean the printing screens. Applicant has found, however, that hot water dissolves the ink faster and makes cleaning easier. In addition, since the screens are warmed by the hot water, they may also dry quicker after washing, without the need for any further drying means, with a consequential saving in time and costs.

Suitably, water at a temperature of between about 60°–80° C.

Figure 7:
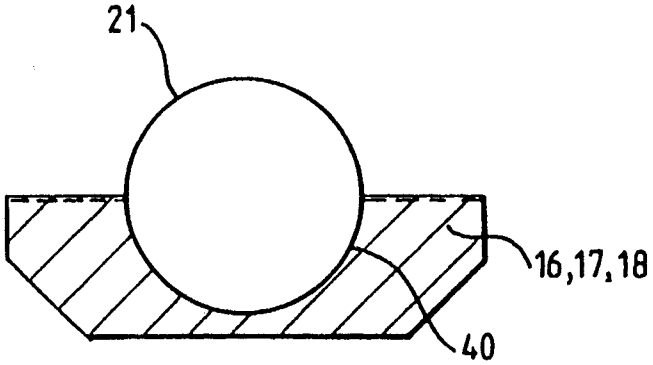
FIG. 7 is a cross-section of a skid and a screen.

Skids 16, 17 and/or 18 shown in FIG. 7 comprise a semi-circular recess 40 in which the screen 21 may be slidably received. Suitably, the skids 16, 17 and 18 of the apparatus 10 are arranged to allow a smooth, substantially uninterrupted sliding passage of the screen 21 into and from the apparatus 10. Each skid is suitably directly opposite each adjacent skid.

Figure 8:
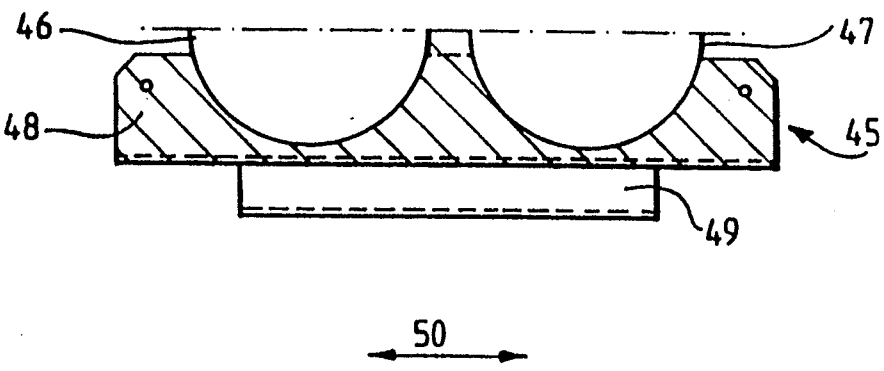
FIG. 8 is a cross-section of a loading skid.

As an alternative to the loading skid 18 being as shown in FIG. 7, it is preferred to provide a skid arrangement 45, as shown in FIG. 8. The skid arrangement 45 comprises two substantially identical skids 46, 47. The skids 46, 47 are carried on a common support frame 48 which, in turn, is carried on support member 49. The arrangement 45 is arranged such that the support frame 48 (and, therefore, skids 46, 47) are slidable in the directions of respective arrows 50, relative to the support member 49.

With the skid arrangement 45 suitably disposed adjacent the entry skid 17 as shown in FIG. 20, the support frame may be moved relative to the stationary support frame so that either one of the skids 46, 47 may be directly opposite entry skid 17. Suitably, in use, a screen to be washed is placed in one skid (for example, skid 46) which is initially disposed directly opposite to the entry skid 17. The screen is then pushed from skid 46 to the entry skid 17 and into the apparatus. Then skid 47 may be arranged directly opposite the entry skid 17 and, when the screen has been cleaned, the screen may be removed from the wash tank 12 into a clean skid 47. Thus, a clean screen is not contaminated by being replaced into the dirty skid from which it came.

The wash tank 12 is suitably arranged to accommodate a screen having a length of about 4 m and a diameter of about 0.25 m. The tank is suitably orientated at an angle of about 6° relative to the horizontal, the entry port 20 being raised thereby relative to the opposite end of the wash tank, so that water may run out of the apparatus away from the entry port end 20 thereof.

The reader's attention is directed to all papers and documents which are filed concurrently with or previous to this specification and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

I claim:

1. Apparatus for cleaning a screen, the apparatus comprising:

a first fluid directing means arranged to direct a cleaning fluid towards a first position on a first side of a screen;

a second fluid directing means arranged to direct a cleaning fluid towards a second position on a second side of the screen, wherein said first and second positions are substantially superimposed; and guide means for guiding the position of the screen to be cleaned relative to said first and second fluid directing means, said guide means defining a gap into which said first and second fluid directing means are arranged to direct fluid.

2. Apparatus according to claim 1, wherein said first and second fluid directing means are arranged such that the force of fluid impinging the screen at said first position due to said first fluid directing means is substantially balanced by the force of fluid impinging the screen at said second position due to said second fluid directing means.

3. Apparatus according to claim 1 wherein said first and said second fluid directing means are fed with fluid from the same fluid source.

4. Apparatus according to claim 1, wherein said first and/or said second fluid directing means are arranged to receive and direct a fluid having a pressure of up to 1500 psi ($1\times10^7$ N/m$^2$).

5. Apparatus according to claim 1, wherein the first fluid directing means is arranged to direct a substantially endless band of cleaning fluid at a screen to be cleaned.

6. Apparatus according to claim 1, wherein the second fluid directing means is arranged to direct a substantially endless band of cleaning fluid at a screen to be cleaned.

7. Apparatus according to claim 1, wherein the screen to be cleaned is substantially circularly cylindrical.

8. Apparatus according to claim 1, wherein said first fluid directing means is provided at a fixed location of the apparatus.

9. Apparatus according to claim 1, wherein said second fluid directing means is provided at a fixed location of the apparatus.

10. Apparatus according to claim 1, wherein said first fluid directing means comprises a plurality of nozzle means communicating with a fluid supply, the nozzle means being circumferentially spaced.

11. Apparatus according to claims 10, wherein the nozzle means are supported on a ring-shaped structure.

12. Apparatus according to claim 1, wherein said second fluid directing means comprises a plurality of nozzle means communicating with a fluid supply, the nozzle means being circumferentially spaced.

13. Apparatus according to claim 12, wherein said nozzle means are supported on a fluid supply pipe.

14. Apparatus according to claim 1, wherein said first fluid directing means comprises a plurality of nozzle means communicating with a fluid supply, said nozzle means being circumferentially spaced; and said second fluid directing means comprising a plurality of nozzle means communicating with a fluid supply, said nozzle means being circumferentially spaced; and wherein the nozzles of the respective first and second fluid directing means are axially spaced relative to one another.

15. Apparatus according to claim 1, wherein the guide means is arranged to provide guided sliding movement of a screen to be cleaned.

16. Apparatus according to claim 1, wherein the apparatus is arranged to accommodate a screen having a length in the range of about 1 meter to 5 meters.

17. Apparatus according to claim 1, wherein the apparatus further comprises loading means for loading a screen to be cleaned into the apparatus.

18. Apparatus according to claim 1, the apparatus further comprising heating means for heating cleaning fluid.

* * * * *